United States Patent [19]

Smiltneek

[11] 4,359,918

[45] Nov. 23, 1982

[54] DIE-CUTTING MECHANISM

[76] Inventor: Ralmond J. Smiltneek, P.O. Box 237, Butler, Wis. 53007

[21] Appl. No.: 140,811

[22] Filed: Apr. 16, 1980

[51] Int. Cl.[3] ..... B26D 5/22; B65H 17/22; B65H 17/46

[52] U.S. Cl. ..... 83/236; 83/155; 83/276; 83/374; 83/650; 242/55

[58] Field of Search ..... 83/235, 236, 222, 155, 83/276, 374, 396, 650; 242/55, 56.1, 58, 55.42

[56] References Cited

U.S. PATENT DOCUMENTS

| | | | |
|---|---|---|---|
| 1,604,304 | 10/1926 | Perkanis | 242/55.42 X |
| 2,170,289 | 8/1939 | Klingler | 83/235 |
| 2,268,242 | 12/1941 | Candee et al. | 83/235 |
| 2,416,509 | 2/1947 | Beaulieu | 242/55.42 X |
| 2,655,212 | 10/1953 | Stewart | 83/235 |
| 3,301,114 | 1/1967 | Joa | 83/236 |
| 3,322,604 | 5/1967 | Schott, Jr. | 83/235 X |
| 3,601,327 | 8/1971 | Baumann | 242/55 |

*Primary Examiner*—Frank T. Yost
*Attorney, Agent, or Firm*—Fred Wiviott

[57] ABSTRACT

A mechanism for die-cutting a laminated strip includes a roll stand having an annular carrier band mounted for rotation about a vertical axis. A plurality of roll mounting assemblies are mounted for discharging strip material onto the carrier band to form a laminated strip. Each roll mounting assembly includes a pivotally mounted roll support which includes a frictional carrier so that the weight of the roll produces frictional forces for pivoting the roll into engagement with the carrier band. A feed assembly transports the laminated strip from the carrier band to a horizontally oriented conveyor belt disposed below a die-cutter driven for vertical reciprocatory movement by a first eccentrically mounted crank arm. The conveyor belt pulleys are disposed on a carrier which is mounted for horizontal reciprocating movement below the die-cutter. The connecting rod is coupled to the carrier reciprocating assembly and to a second eccentric mounted on the first eccentric. By properly proportioning the radius of eccentricity of the eccentrics and their relative rotational velocity, a zero relative velocity between the cutter head and conveyor belt can be achieved for a predetermined time during each operating cycle.

14 Claims, 8 Drawing Figures

DIE-CUTTING MECHANISM

BACKGROUND OF THE INVENTION

This invention relates to die-cutting machines and more particularly to machines for forming and cutting shaped articles from multi-layered strips of feed material.

Die-cutting machines are employed for cutting shaped paper items, such as coffee filters, from multiple layered strips of feed material. In order to provide the multi-layered feed stock, as a roll stand is generally provided for laminating the feed stock from a plurality of individual rolls and for feeding the same to a die-cutter. The die-cutters are generally reciprocating devices which require that the multi-layered stock be fed under the dies while they are retracting, but which must be stopped for a finite period of time while the dies advance to perform their cutting function. This requires the expenditure of considerable energy in overcoming the inertia incident to the starting and stopping of the strip conveyor during each cutting operation.

The dies of such strip cutting material are generally arranged in a suitable pattern for conservation of feed stock material. The width of the feed stock is not only determined by the cutting head pattern, but allowances must also be made for lateral wandering of the web due to lamination inaccuracies. Such feed stock inaccuracies due to web wandering can result in substantial cost because the feed stock must be wider than would otherwise be necessary. One source of such inaccuracies in prior art apparatus was the open gap that existed between the roll stand and the die-cutter conveyor assembly.

SUMMARY OF THE INVENTION

It is an object of the invention to provide a new and improved die-cutter assembly.

A further object of the invention is to provide a die-cutter assembly wherein waste of feed stock material is minimized.

A further object of the invention is to provide apparatus for forming a laminated strip of feed material wherein a high degree of registry is maintained.

Another object of the invention is to provide a die-cutter assembly wherein the feed stock is maintained relatively stationary with respect to the cutter head without the necessity for overcoming inertia in a large number of mechanical components.

These and other objects and advantages of the present invention will become more apparent from a detailed description thereof taken with the accompanying drawings.

According to one of its aspects, the invention comprises a die-cutter including a conveyor for transporting strip material in a first direction and beneath a cutter head, first means for reciprocating the cutter head in a second direction normal to the first direction and into and out of cutting engagement with the strip material on said conveyor, second means coupled to the first means for displacing the conveyor in the first direction and an opposite direction, the second means being coupled to the first means for displacing the conveyor in the opposite direction for predetermined portion of the cutting stroke of the cutting head.

According to another of its aspects, the invention comprises apparatus for forming a laminated strip and including a carrier ring, a drive for rotating the carrier ring about a first axis, a plurality of supports for respectively supporting a plurality of rolls of material adjacent the ring and for rotation about a support axis parallel to the axis of the ring, each support being pivotally mounted about an axis spaced from and parallel to the support axis, for movement toward and away from the ring, and restraint on said second means for restricting the rotation of said rolls as said material is discharged onto said ring to produce a torque on the support for pivoting the roll into engagement with the ring.

DESCRIPTION OF THE PREFERRED EMBODIMENT

Figure 1:
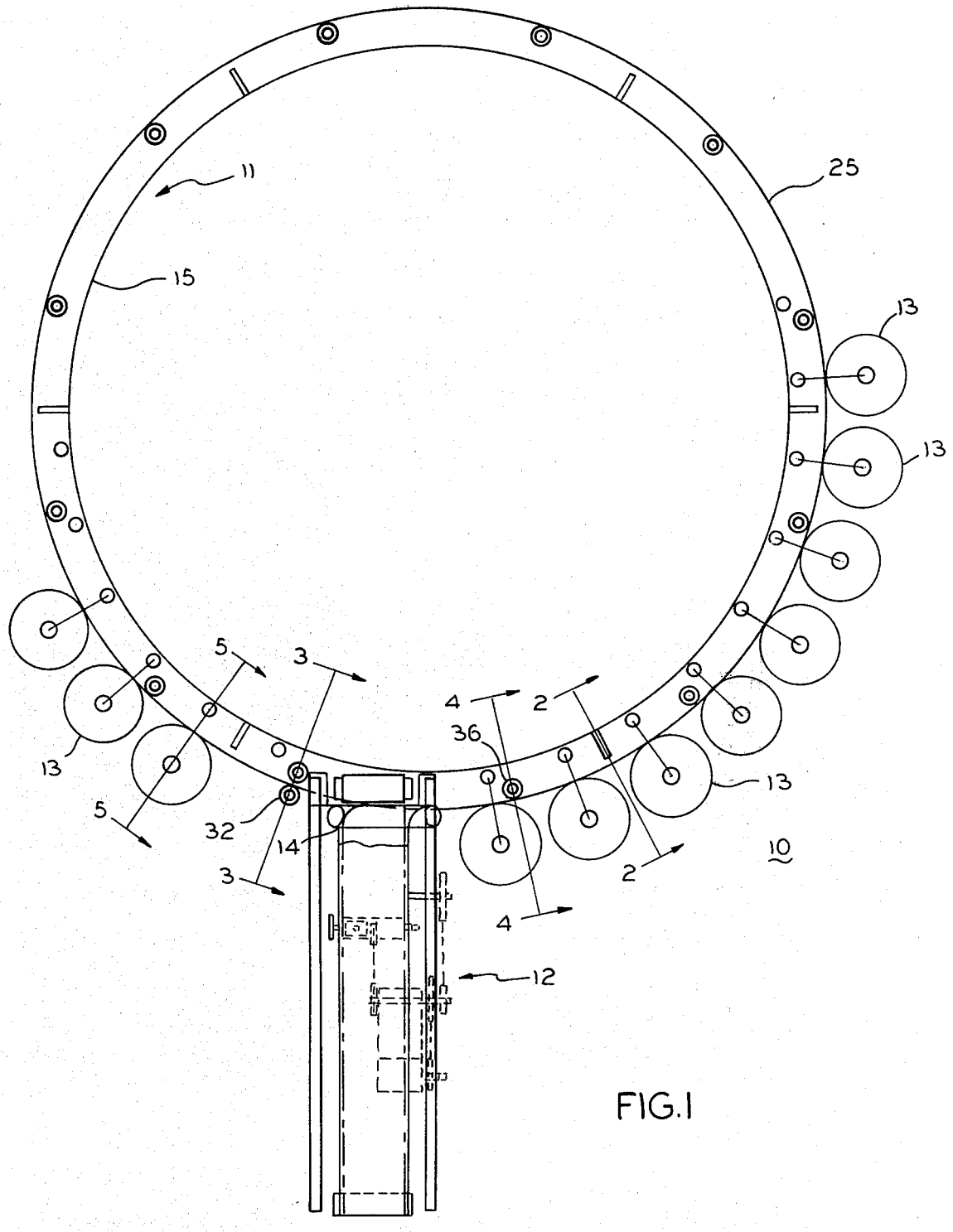
FIG. 1 is a top plan view of the die-cutter assembly according to the preferred embodiment of the present invention.

The die-cutting machine 10 according to the preferred embodiment of the present invention as shown in FIG. 1 to include roll stand 11 and a die-press 12. Mounted on roll stand 11 are a plurality of rolls 13 of strip material which are fed onto the roll stand 11 to form a laminated strip 14. From the roll stand 11 the laminated strip 14 is delivered to the die-press 12 for being cut into the desired shapes.

Figure 2:
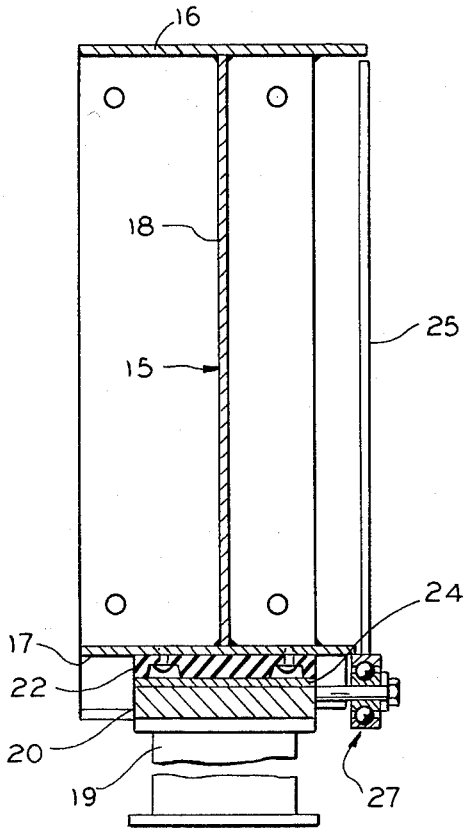
FIG. 2 is a view taken along lines 2—2 of FIG. 1.
Figure 3:
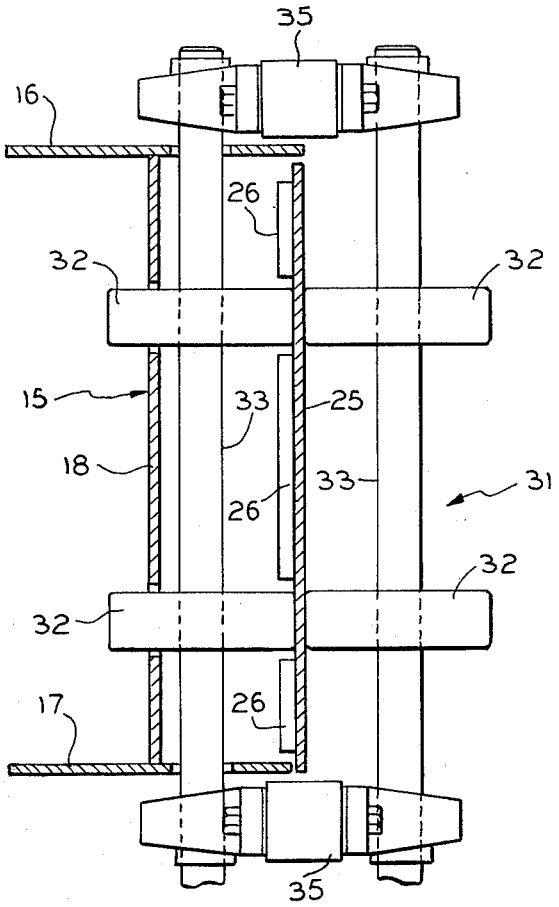
FIG. 3 is a view taken along lines 3—3 of FIG. 1.
Figure 4:
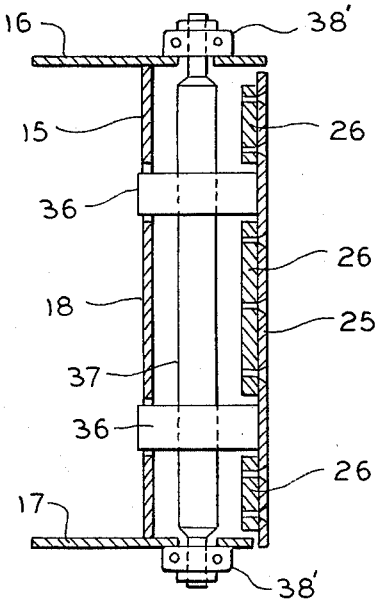
FIG. 4 is a view taken along lines 4—4 of FIG. 4.

With reference to FIGS. 2–5, roll stand 11 is shown to include a stationary main frame 15 comprising annular upper and lower flanges 16 and 17 and an annular center web 18 which define a ring that is I-shaped in transverse cross-section. Frame 15 is supported in a general horizontal orientation by a plurality of vertical support columns 19, only one of which is seen in FIG. 2. An anti-friction bearing pad 20 is attached to the lower flange 17 of ring 15 and a resilient cushioning material 22 and a slipper plate 24 are disposed between the pad 20 and the flange 17. This provides a compliant and self-adjusting support for ring 15.

As seen in FIGS. 1–5, a cylindrical carrier band 25 is disposed about the periphery of main frame 15. Band 25 may be formed of a single strip or a plurality of shorter strips, which in either case are joined end to end in any suitable manner, such as by splice plates 26. A plurality of rollers 27 are suitably mounted for rotation about horizontal axis on the lower flange 17 of the main frame 15 and in spaced-apart relation for supporting the carrier band 25. The carrier band 25 may be rotated on rollers 27 and relative to the main frame 15 by a drive 31 consisting of two pair of spaced-apart, elastomer covered rollers 32 which engage the opposite surfaces of band 25. Each pair of rollers 32 is mounted on one of a pair of spaced, parallel shafts 33 which are supported for rotation on the opposite sides of band 25 by an adjustable support 35 which permits changes in the pressure of rollers 32 on the surfaces of band 25. A suitable drive (not shown) is connected to shafts 33 to provide motive power for rotating band 25.

The band 25 is positioned relative to frame 15 by a plurality of pairs of spaced-apart elastomer covered rollers 36 mounted on shafts 37. Each shaft 37 is suitably mounted on the upper and lower flanges 16 and 17 and generally parallel to web 18 by bearings 38' whereby rollers 36 rotatably engage the inner surface of band 25.

Figure 5:
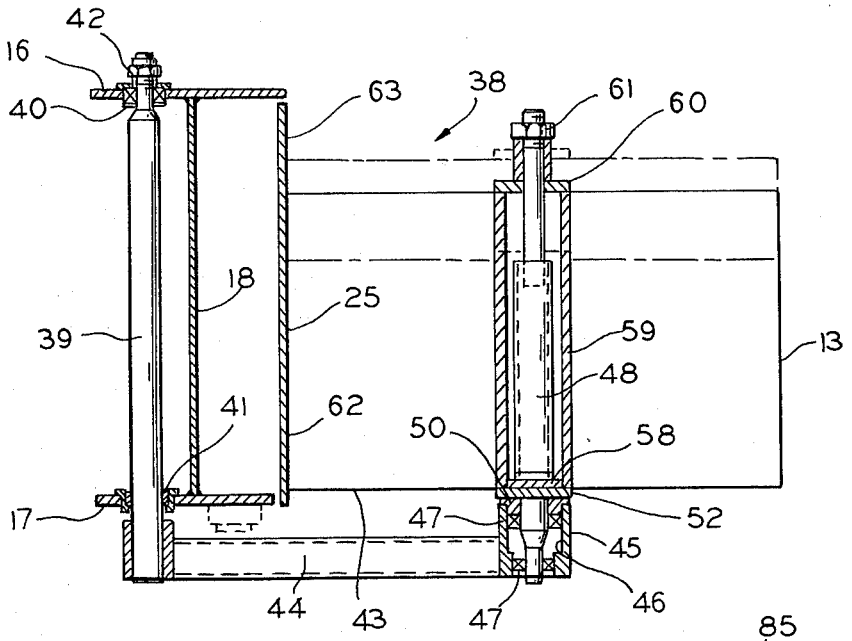
FIG. 5 is a view taken along lines 5—5 of FIG. 1.

The rolls 13 of strip material which are fed onto the roll stand 11 are individually mounted on one of a plurality of identical roll stock supporting mechanisms 38. Specifically, each supporting mechanism 38 is shown in FIG. 5 to include a vertically extending, elongate support rod 39 whose opposite ends are received in aligned bearings 40 and 41 disposed respectively in the upper and lower flanges 16 and 17 of roll stand main frame 15. The upper end of rod 39 is of reduced diameter and threaded for receiving an adjustment nut 42 to permit vertical adjustment of roll stock 13 so that its lower edge 43 may be precisely aligned and registered with similar lower reference edges of other roll stocks 13 mounted and arranged around the outer periphery of roll stand 11.

Affixed to the lower end of rod 39 is one end of a horizontally extending guide arm 44. A hub 45 is mounted on the other end of arm 44 and has a vertically oriented bore 46 which contains spaced-apart bearings 47 for rotatably supporting the lower end of a vertically extending spindle shaft 48. Disposed at the upper end of bore 46 is an annular friction brake pad 50 whose upper surface is engaged by the lower surface of a friction disc 52 mounted above the lower end of spindle shaft 48. The friction brake pad 50 and the spindle weight are chosen so that each web being fed from its roll stock 13 is kept in relatively constant tension regardless of the diameter of the stock remaining on the roll. This insures that the web laminations are maintained in alignment to minimize waste in the cutting phase.

Mounted on spindle shaft 48 and above brake disc 52 is a centering disc 58 whose outer diameter coincides with the inner diameter of the cylindrical core 59 of the roll stock 13. In addition, a centering clamp 60 secured at the upper end of core 59 by a nut 61 is threaded on the upper end of spindle 48 so that the peripheral surface 62 roll stock 13 may be clamped in parallel alignment with the adjacent surface 63 of carrier band 25.

The operation of the roll stand 12 will now be discussed. The desired lamination 14 of strip material is provided by placing the web from an initial roll 13 upon the surface of the carrier band 25 and the web from each successive roll 13 upon that of the preceding web. This provides a multi-layered web 14 of roll stock on the face of carrier band 25. It will be appreciated that the number of layers of web material in each lamination will be determined by the number of active roll stations.

As the web from each roll stock 13 is fed against the rotating surface carrier band 25, the restraining torque resulting from the friction between each brake pad 50 and friction disc pair urges its associated roll spindle guide arm 44 to pivot about support rod 39 whereby the outer surfaces of the roll stocks 13 are held in firm contact with the surface 62 of carrier band 25 as the material is fed from roll 13. The resulting tension in the web eliminates gaps between the parent surface of the roll stock 13 and the carrier band to facilitate maintaining a proper register of the individual webs being fed from their respective roll stocks 13. This restraining torque, in addition to the vertical face alignment provided by the centering clamp 60, the reference edge alignment provided by the vertical adjustment of the shaft 39 and the tension applied to the roll stock carrier band 25 by rollers 31 helps insure precise web register which is important in reducing waste during the die-cutting operation.

While the overall diameter of roll stand main frame 15 and carrier band 25 and the number of roll stations 13 is a matter of design choice, in an illustrative example, a main frame diameter of approximately 15 feet was employed with 27 roll stations spaced about the periphery through an arc of approximately 300°.

Figure 7:
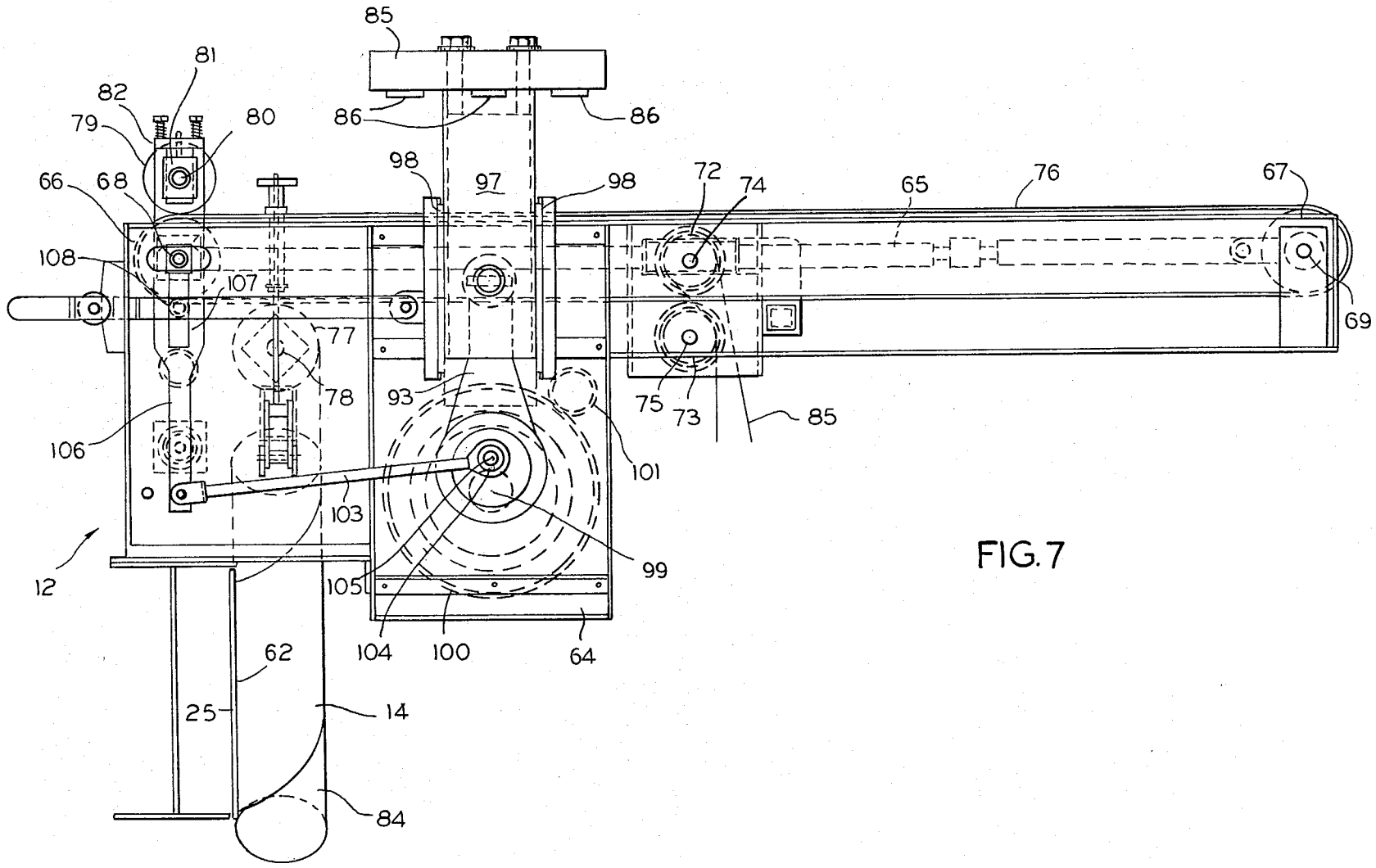
FIG. 7 is a view taken along lines 7—7 of FIG. 6.

FIG. 7 shows the die-press 12 to include a main frame 64 which supports an elongate carrier 65 for axial reciprocating motion in a generally horizontal direction. Those skilled in the art the carrier 65 may be supported on frame 64 for horizontal movement in any well known manner. For example, suitable bearings (not shown) may be provided. Disposed at the opposite ends of carrier 65 are a pair of pulleys 66 and 67 respectively mounted for rotation on parallel spaced-apart shafts 68 and 69 which are journaled on and extend generally perpendicularly relative to carrier 65. Disposed between pulleys 67 and 68 are a pair of elastomer covered traction rolls 72 and 73 which are mounted on shafts 74 and 75 for rotation on frame 64 about fixed axis parallel to the axis of shafts 68 and 69. An endless conveyor belt 76 passes around pulleys 66 and 67 and between traction rolls 72 and 73. A feed roll 77 is mounted on a shaft 78 journaled in frame 64 for rotation about a fixed axis generally parallel to that of pulley 68. Disposed above pulley 66 is a compression roll 79 having a shaft 80 rotatably mounted on block 81 adjustably carried on a support 82 extending upwardly from carrier 65. A die platen 85 is mounted above the belt 76 for vertical reciprocatory motion and has cutting dies 86 on its lower surface.

Figure 6:
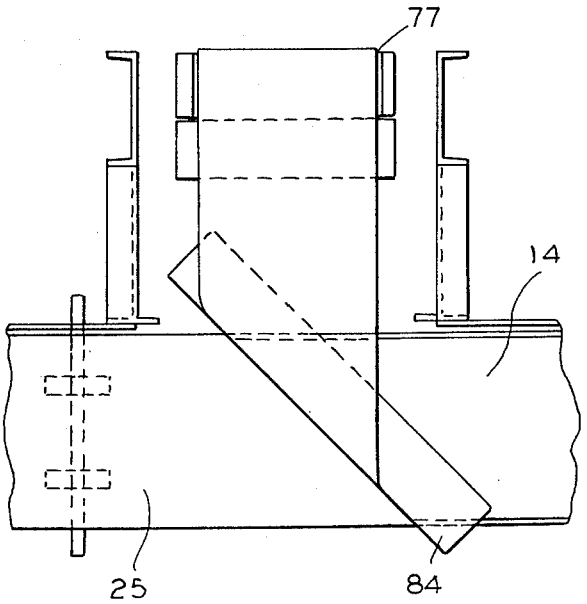
FIG. 6 is a view taken along lines 6—6 of FIG. 1.
Figure 8:
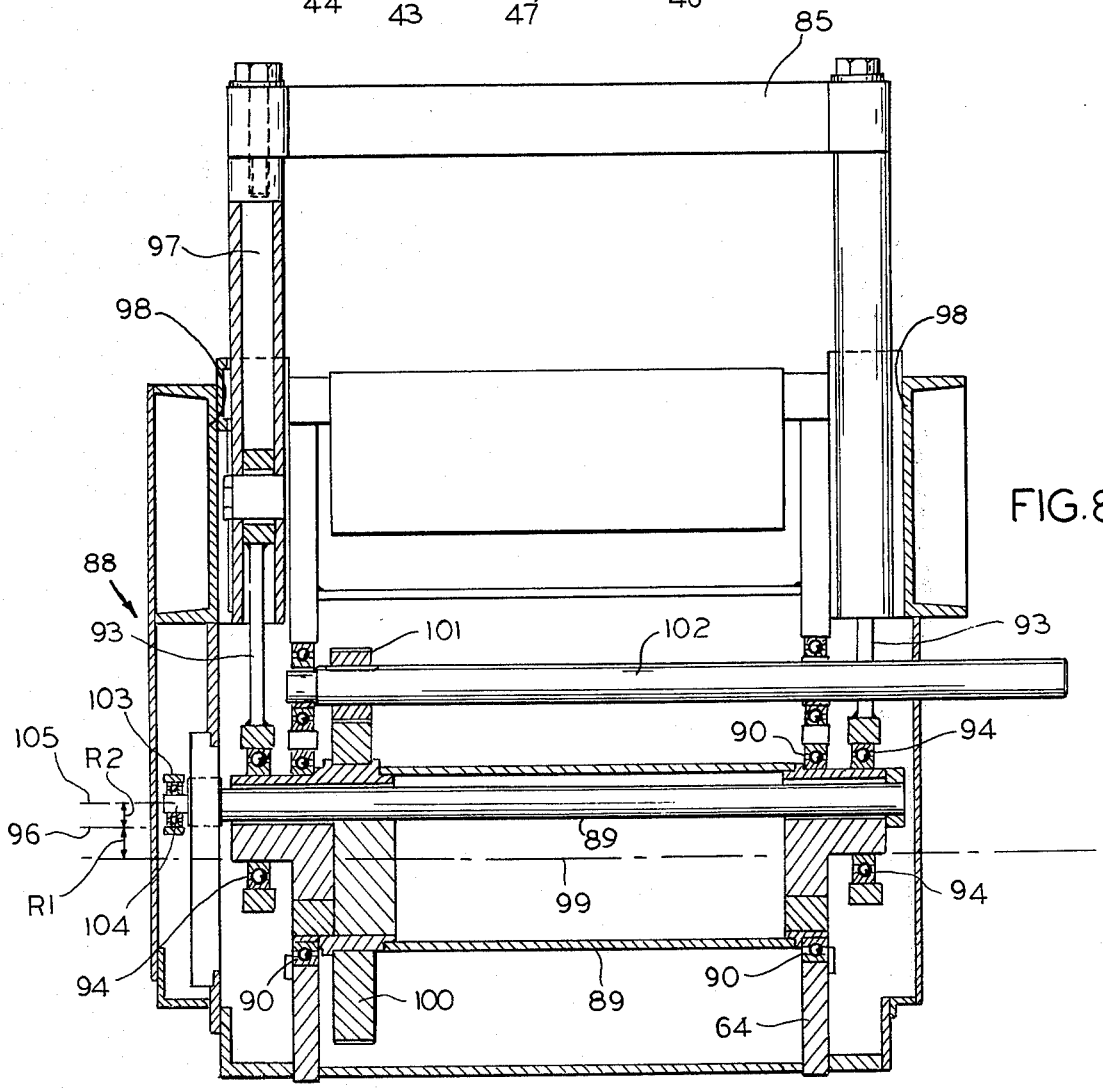
FIG. 8 is a view taken along lines 8—8 of FIG. 6.

After laminating the web 14 on the carrier band 25 in the manner described above, the web 14 is fed to the die-press 12. However, as seen in FIGS. 1 and 7, the surface of the conveyor belt 76 is oriented generally horizontally while the surface 62 of carrier band 25 is generally vertical and below belt 76. As a result, the laminated strip 14 must be reoriented through an angle of approximately 90° and redirected upwardly. Toward this end, a guide roll 84 (FIGS. 1, 6 and 8) is mounted on frame 64 and adjacent the face 62 of band 25 and below conveyor belt 76. Roll 84 does not rotate but has a low friction surface which permits the web 14 to pass therearound without undue drag. As seen in FIG. 6, the axis of roll 84 is oriented at an angle of approximately 45° relative to the horizontal. While the manner of supporting the roll 84 on frame 64 is not shown, it will be appreciated that this may be accomplished in any manner well known in the art. The laminated strip 14 passes between the band 25 and the roll 84, around the underside of roll 84 and then upwardly across its front surface to achieve the 90° direction change and redirection upwardly.

After passing around the guide roll 84, and undergoing a change in direction and orientation, the strip 14 is fed between the feed roll 77 and the conveyor belt 76. The traction rolls 72 and 73 which drive belts 76 are in turn driven by a belt drive assembly (not shown) through the agency of a belt 85. It will be appreciated that the peripheral speed of carrier band 25, and hence, the discharge speed of the laminated strip 14 will be governed by the speed at which rolls 32 (FIG. 3) are driven. It is desirable that the guide band 25 and the die-cutter conveyor belt 76 should run at speeds which are approximately equal, but which provide a substantially constant tension on the laminated strand 14 in the gap between the idler roll 84 and the feed roll 77. If the die-cutter belt 76 is driven too fast, there will be excessive sliding of the web 14 relative to both the conveyor belt 76 and the guide band 25 resulting in loss of lateral position accuracy. If the die-cutter belt is driven too slow, web tension will not be maintained and the web will fall off of the guide band. In the preferred embodiment of the invention, the guide band 25 and the die-cutter conveyor belt 76 are driven mechanically in a fixed ratio such that when no web is present, the drive rolls 72 and 73 drive the belt 76 about five percent faster than the peripheral speed of the guide band 25. However, because of their elastic nature, the elastomer covered traction wheels, which drive both the band 25 and the belt 76, can be allowed by means of pressure adjustment to slip slightly when the load presented by the laminated strip is applied.

After passing around traction roll 77, the laminated strip 14 is carried by belt 76 between pulley 66 and roller 79 and along the top of the belt 76 to a position to beneath the reciprocating die-cutter head 85. It will be appreciated that while the laminated strip 14 is moving horizontally along with conveyor belt 76, the reciprocating die-cutter 85 will be moving vertically. As a result, there must be a short interval during which there is no horizontal movement of strip 14 relative to die-cutter head 86 in order to make a uniform cut through all of the laminations. This is accomplished by the die-cutter drive mechanism 88 which will now be described.

The drive mechanism 88 includes a crankshaft 89 mounted on frame 64 for rotation about a horizontal axis by means of bearings 90. A pair of crank arms 93 is mounted on the opposite ends of crank 89 by means of bearings 94 for relative pivotal movement about an axis 96 which is eccentrically located relative to the rotation axis 99 of crankshaft 89 by the distance $R_1$. The upper end of crank arms 93 is connected to a vertically extending frame 97 which carries the die-cutter 86 at its upper end. The frame 97 also passes between a vertically oriented guide plates 98 which are mounted on frame 64. The crank 89 is rotated about its axis 99 by means of a gear 100 affixed thereto and which is driven by second gear 101 coupled to the drive (not shown) by shaft 102. It will be appreciated that as gear 100 rotates, the crank arms 93 will move vertically to reciprocate the frame 98 and the die-cutter head 85 vertically. In this manner, the die-cutter head 85 will move into the cutting engagement with the laminated strip 14 being carried by the conveyor belt 76.

A connecting link 103 is pivotally mounted at one end to a shaft 104 affixed to crank shaft 89 and extending along an axis 105 which is eccentrically disposed relative to the axis 96 of crank arms 93 by the distance $R_2$ and the rotational axis 99 of crankshaft 89 by the distance $R_1+R_2$. The other end of link 103 is pivotally connected to the lower end of a link 106 having a pair of arms 107 extending vertically from its upper end. The tips of arms 107 enbrace the shaft 68 of pulley 66. Intermediate the ends of arms 107 there is a roller 108 which is rotatably mounted on frame 64. It will be appreciated that as gear 100 rotates clockwise from its position shown in FIG. 7, the cutter head 85 will move downwardly. Simultaneously, the link 103 will move to the right thereby pivoting link 106 counterclockwise about roller 108 thereby displacing the shaft 68 toward the left. This will move the carrier 65 and the pulley 66 toward the left. Meanwhile, the lower portion of the belt 76 will be moved toward the left by the pinch rolls 72 and 73 while the upper portion of belt 76 will be moved toward the right. If the peripheral speed of the rollers 72 and 73 is twice the speed at which the carrier 65 is being displaced horizontally, there will be zero relative movement of the upper portion of belt 76 relative to the die-cutter 86.

It will be appreciated that in order to make a clean cut of the laminated strand 14 without disturbing registry, the belt 76 should be stationary relative to the die-cutter head 86 for the period of time necessary for the head 86 to penetrate the strip 14, stop, reverse direction and withdraw above the surface of the strand. Since the cutter 85 will be at its nadir when the crank arms 93 are at their bottom dead center positions, the belt 76 must be relatively stable as the cutter 86 moves through this position. It has been found in practice that belt 76 is preferably in this relatively zero velocity state for approximately one-sixth of a cycle or while gear 100 travels through an angle of approximately 30° on each side of its bottom dead center position. This is accomplished first by superimposing the second eccentric $R_2$ of connecting rod 103 on the first eccentric $R_1$ of the crank arms 93. Secondly, the second eccentric $R_2$ should be 90° out of phase with the first eccentric $R_1$. In other words, the connecting rod 103 should reach the extremes of its travel in the lateral direction 90° out of phase with the top and bottom dead center positions of crank arms 93.

In order to achieve the desired results, the lengths and frequencies of rotation of $R_1$ and $R_2$ must have a predetermined relation. For example, the motion of the position of a point on the crank arms 93 can be expressed as follows:

$$X_1 = R_1 \text{ Sin } wt$$

where wt is the angular position of crankshaft 89. This expression, of course, defines a classical sin curve. The position of a point on link 103 wherein the second eccentric is superimposed on the first is:

$$X_2 = R_1 \text{ Sin } wt - R_2 \text{ Sin } bwt$$

if $R_2$ equals $kR_1$ then $$X_2 = R_1 (\text{Sin } wt - k \text{ Sin } bwt)$$

The velocity of $X_2$ will then be:

$$V_2 = \frac{dx}{dt} = R_1 w(\cos wt - bk \cos bwt)$$

It has been found that when k equals 0.045 and b equals three, the velocity $V_2$ can be made relatively constant over the required 60°. Thus, in order to achieve the desired results, the distance $R_2$ should be $0.045R_1$ and the frequency of the second crank arm 104 should be three times that of the first crank arms 93.

While only a single embodiment of the invention has been illustrated and described, it is not intended to be limited thereby but only by the scope of the appended claims.

I claim:

1. Apparatus for die-cutting a laminated strip including a carrier ring, drive means for rotating said carrier ring about a first axis, a plurality of support means for respectively supporting one of a plurality of rolls of strip material adjacent said ring and for rotation about a support axis parallel to the axis of said ring, each support means being pivotally mounted about an axis spaced from and parallel to said support axis for movement toward and away from the carrier ring, and restraint means on said support means for restricting the rotation of said rolls as said material is discharged onto said ring to produce a torque on the support for pivoting the roll into engagement with the ring, cutter means spaced from said carrier ring, conveying means for receiving strip material from said ring and for transporting said material in a first direction and beneath said cutter means, first reciprocating means coupled to said cutter means for reciprocating the cutter means in a second direction normal to the first direction and into and out of cutting engagement with the strip material on said conveying means, second reciprocating means coupled to the first reciprocating means for displacing said conveying means in said first and an opposite direction, said second reciprocating means being coupled to said first reciprocating means for displacing said conveying means in said opposite direction for predetermined portion of the cutting stroke of said cutter means.

2. The die-cutter set forth in claim 1 wherein said conveying means includes a conveyor belt, the upper surface of said conveyor belt lying in a first plane, the surface of said carrier ring extending in a direction perpendicular to said first plane, and guide roll means disposed adjacent said carrier ring and having a nonrotating axis which intersects the plane of said conveyor belt surface at an angle of approximately 45°, said strip material extending from said carrier ring and around said guide roller to said conveyor belt.

3. The die-cutter set forth in claim 2 wherein said first reciprocating means includes rotatably mounted crank having a first radius of eccentricity and coupled to said cutter means for reciprocating the same, said second reciprocating means being coupled to said first reciprocating means and at a second radius of eccentricity having a predetermined relation to said first radius of eccentricity.

4. The combination set forth in claim 2 or 3 and including a frame, said carrier ring being rotatably mounted on said frame, said second means including an arm pivotally mounted on said frame and a spindle rotatably mounted on said arm and extending along said support axis, said restraint means comprising a brake being disposed between said spindle and said arm.

5. The die-cutter set forth in claim 4 wherein said conveyor belt comprises an endless belt, a carrier for supporting said conveyor belt, drive means for moving said conveyor belt relative to said carrier, said second reciprocating means being coupled to said carrier and being operative to displace said carrier in said first and opposite directions.

6. The die-cutter set forth in claim 5 wherein pulley means are disposed at the opposite ends of said carrier, said conveyor belt extending around said pulley means and drive roll means engaging said conveyor belt for moving the same around said pulley means.

7. Means for forming a laminated strip including a carrier ring, drive means for rotating said carrier ring about a first axis, a plurality of support means for respectively supporting one of a plurality of rolls of material adjacent said ring and for rotation about a support axis parallel to the axis of said ring, each support means being pivotally mounted about an axis spaced from and parallel to said support axis for movement toward and away from the ring, and restraint means on said support means for restricting the rotation of said rolls as said material is discharged onto said ring to produce a torque on the support for pivoting the roll into engagement with the ring.

8. The combination set forth in claim 7 and including a frame, said carrier ring being rotatably mounted on said frame, said support means including an arm pivotally mounted on said frame and a spindle rotatably mounted on said arm and extending along said support axis, said restraint means comprising a brake being disposed between said spindle and said arm.

9. The combination set forth in claim 7 or 8 and including a plurality of rollers mounted on said support frame, said carrier ring comprising a generally cylindrical member mounted on said rollers for rotation on said frame and about said first axis.

10. Means for forming a laminated strip including a relatively rigid carrier ring, drive means for rotating said carrier ring about a first axis, a plurality of support means for respectively supporting one of a plurality of rolls of strip material in spaced apart relation relative to each other and adjacent to said ring, each said support means being mounted for rotation about an axis parallel to the axis of said ring so that when the material in each row is placed in engagement with the surface of the ring and said ring is rotated, the strip material in each roll will feed out onto the ring to form a lamination of said strip material, and restraining means on each said support means for restricting the rotation of said rolls as said material is discharged onto said ring to produce a tension in each of said strips, thereby causing each strip to press onto the surface of the ring as each of said rolls unwinds.

11. The combination set forth in claim 10 and including a frame, said carrier ring being rotatably mounted on said frame, said support means including an arm pivotally mounted on said frame and a spindle rotatably mounted on said arm and extending along said support axis, said restraining means comprising a brake being disposed between said spindle and said arm.

12. The combination set forth in claim 10 or 11 and including a plurality of rollers mounted on said support frame, said carrier ring comprising a generally cylindrical member mounted on said rollers for rotation on said frame and about said first axis.

13. Apparatus for die-cutting a laminated strip including a carrier ring, drive means for rotating said carrier ring about a first axis, a plurality of support means for respectively supporting one of a plurality of rolls of strip material adjacent said ring and for rotation about a support axis parallel to the axis of said ring, each support means being pivotally mounted about an axis spaced from and parallel to said support axis for movement toward and away from the carrier ring, and restraint means on said support means for restricting the rotation of said rolls as said material is discharged onto said ring to produce a torque on the support for pivoting the roll into engagement with the ring, cutter means for receiving strip material from said ring and for transporting said material beneath said cutter means, and reciprocating means coupled to said cutter means for reciprocating the cutter means into and out of cutting engagement with the strip material on said conveying means.

14. The die-cutter set forth in claim 13 wherein said conveying means includes a conveyor belt, the upper surface of said conveyor belt lying in a first plane, the surface of said carrier ring extending in a direction perpendicular to said first plane, and guide roll means disposed adjacent said carrier ring and having a nonrotating axis which intersects the plane of said conveyor belt surface at an angle of approximately 45°, said strip material extending from said carrier ring and around said guide roller to said conveyor belt.

* * * * *